United States Patent [19]

Roda

[11] 4,200,032

[45] Apr. 29, 1980

[54] MACHINE FOR ERECTING SHEET MATERIAL PACKAGING ARTICLES

[75] Inventor: Emilio Roda, Viganello, Switzerland

[73] Assignee: Roda Macchine S.A., Noranco, Switzerland

[21] Appl. No.: 889,212

[22] Filed: Mar. 23, 1978

[30] Foreign Application Priority Data

May 26, 1977 [CH] Switzerland ..... 6612/77

[51] Int. Cl.[2] ..... B31B 1/26

[52] U.S. Cl. ..... 93/37 SP; 93/49 R

[58] Field of Search ..... 93/37 SP, 49 R, 51 R, 93/50, 36.3

[56] References Cited

U.S. PATENT DOCUMENTS

| | | | |
|---|---|---|---|
| 2,709,399 | 5/1955 | Smith | 93/49 R |
| 3,952,634 | 4/1976 | Rollins et al. | 93/49 R |
| 3,978,773 | 9/1976 | Pinto | 93/37 SP |

FOREIGN PATENT DOCUMENTS

| | | | |
|---|---|---|---|
| 1010956 | 1/1977 | Italy | 93/37 SP |

*Primary Examiner*—Z. R. Bilinsky

*Attorney, Agent, or Firm*—Young & Thompson

[57] ABSTRACT

The present invention relates to a machine for erecting cardboard or the like into packaging articles having single or multiple ribs derived from glued folds.

6 Claims, 20 Drawing Figures

Fig. 17
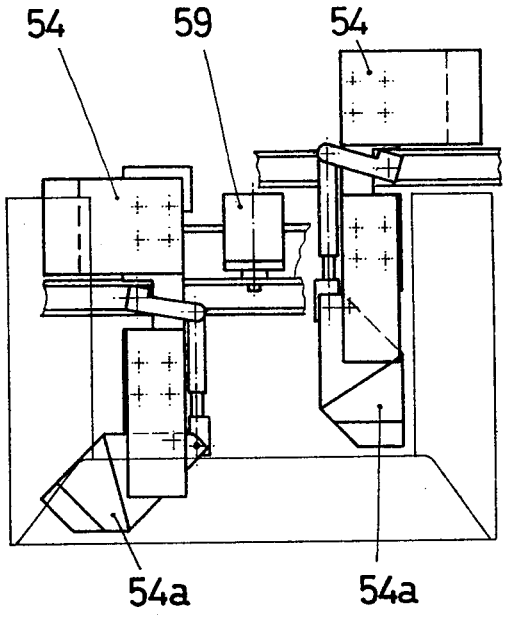
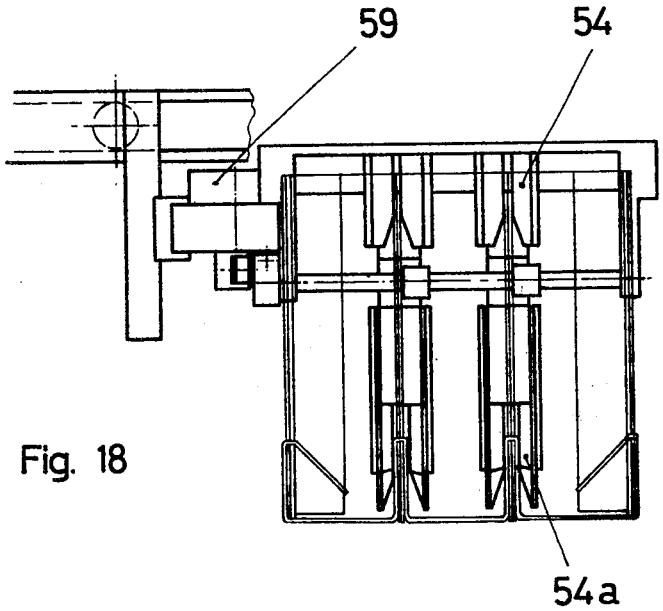
Fig. 18

Fig. 19
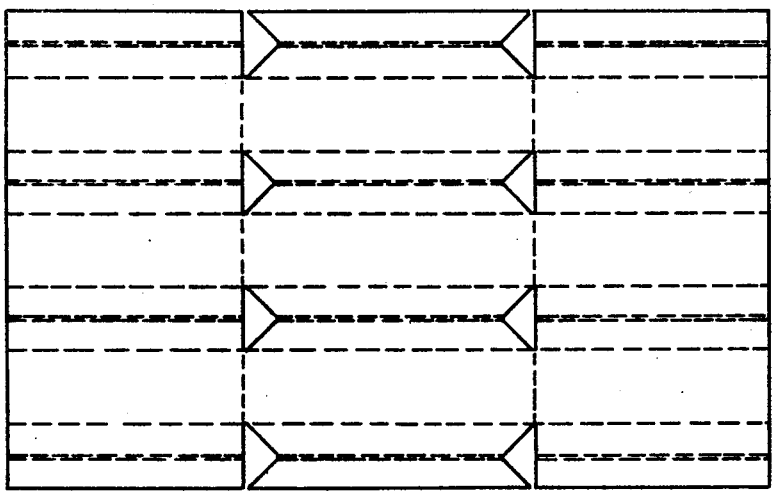
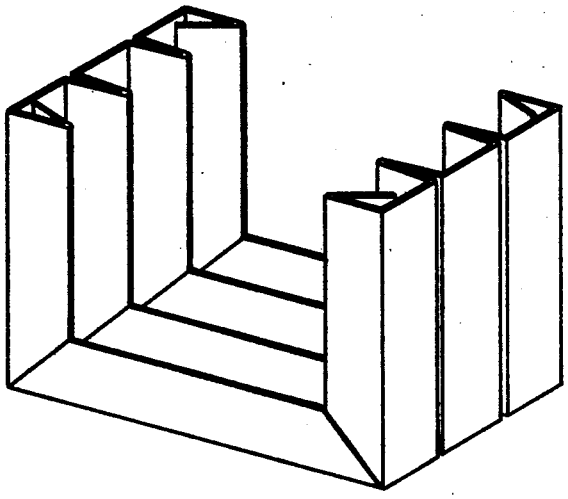
Fig. 20

MACHINE FOR ERECTING SHEET MATERIAL PACKAGING ARTICLES

The present invention relates to a machine for erecting cardboard or the like into packaging articles having single or multiple ribs derived from glued folds. The machine is in particular for erecting so called "beam boxes" with ribs parallel to one another, from a blank according to Italian Patent No. 1,010,956.

According to the invention there is provided a machine for erecting packaging sheet materials such as cardboard into packaging articles having a base and lateral walls or multiple ribs derived from glue folds, said machine having a receiving station for receiving the packaging sheet material to be formed into the articles, first members adapted to initiate the folding of the sheet material to give rise to the ribs of the box; second members adapted to fold two lateral edges of the sheet material to form the reinforcement of the walls and to fold them into V-shape, third members adapted to insert glue between the or each fold immediately before its closing to form a rib, fourth members adapted to fold by 90° two lateral walls of the article relative to the box; fifth members adapted to insert the finished box into a frame or hopper which holds it in its final shape until setting of the glue takes place.

Preferably, the machine includes an automatic insertion comprises for inserting the sheet material into the receiving station and comprising a carriage mounted for alternating movement, said carriage including suckers of adjustable height for removing blanks of said sheet material from a stack of such blanks.

Preferably also, the said first members are constructed by spaced lower longitudinal guides and by upper spaced longitudinal guides interspaced with said lower guides said guides being to correspond to creasings on the sheet material to be folded the rib or ribs and said second members comprise two right angled formers hinged at one end and rotatable by 90° and V-shaped guides operated by pneumatic or hydraulic pistons.

Embodiments of the invention will now be described, by way of example, with reference to the accompanying drawings, wherein:

FIGS. 9 to 18 show a machine according to a second embodiment of the invention;

FIG. 19 shows a blank from which a packaging article is made; and

FIG. 20 shows a packaging article made from the blank of FIG. 19; and as regards the particular FIGS. 1 to 18;

FIG. 1 shows in end and diagrammatic view longitudinal guides which serve to perform initial pre folding of the blank of FIG. 19.

FIG. 2 shows the said guides of FIG. 1 at a later stage of folding of the blank.

FIG. 3 shows how glue is inserted in the folds formed in the blank.

FIG. 4 shows how the lateral edges of the blank are folded.

FIG. 5 shows how the side walls of the packaging article are folded relative to the base section.

FIGS. 6, 7 and 8 show the final stages in the formation of the packaging article;

FIG. 9 shows in side view the end of a machine according to a second embodiment according to the invention.

FIG. 10 shows in end view the entry end of the machine shown in FIG. 9.

FIG. 11 shows in end view the section of the machine for effecting the longitudinal folding phase of the blank;

FIG. 12 shows how the blank is folded longitudinally and transversely;

FIG. 13 shows the packaging article held in final form in hoppers of the machine;

FIG. 14 shows how the machine folds the lateral walls of the blank are folded relative to the base thereof;

FIG. 15 shows the formed article;

FIG. 16 shows a side view the section of the machine at the outlet end of the machine;

FIG. 17 shows in side view a group of securing pincers of the machine for the glueing of the blank, the pincers being shown respectively in the open condition and in the closed condition; and FIG. 18 shows in end view the securing pincers of FIG. 17 for the glueing seen in the box in the working phase.

The first embodiment of the machine will now be described with reference to all FIGS. 1 to 8.

Figure 1:
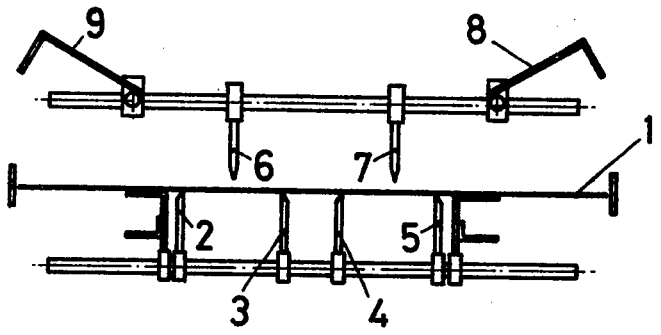
FIGS. 1 to 8 show a first preferred embodiment of a machine according to the invention.

The insertion of the blank into the machine is by hand or by automatic inserters of known type. The blank 1 is inserted on a series of lower longitudinal guides 2,3,4,5 as indicated in FIG. 1.

Figure 2:
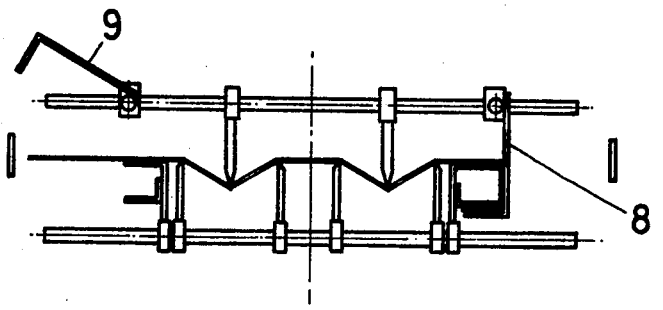

After the sheet has been inserted, the series of upper longitudinal guides 6, 7 is lowered together to the lower guides and the guides are arranged to correspond to the creasing of the blank as shown in FIG. 19 so at to prefold the inner ribs as in FIG. 2. The long right angles arms 8,9 and the blank are lowered taking up the position indicated in the right hand side of FIG. 2, effecting partial folding of the lateral edges of the blank.

Figure 3:
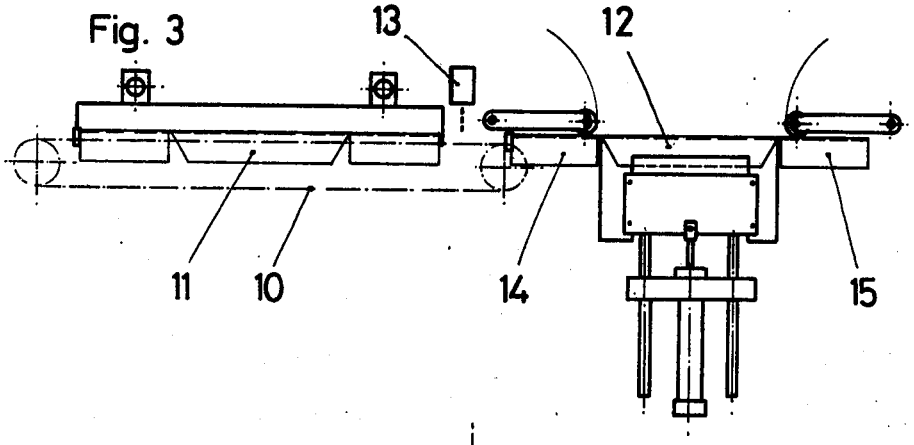
Figure 4:
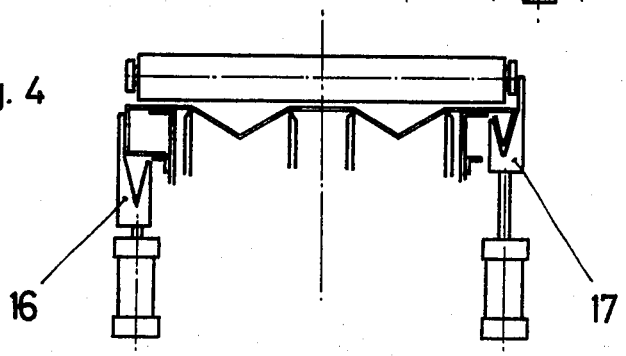

As shown in FIG. 3 which shows the machine in side view, the prefolded sheet is pushed by a pusher 10 mounted on a chain from the position 11 to the position 12. In passing between such positions glue is applied from the device 13 at the locations where it is required for sticking the ribs. In position 12, the blank is located in the condition as shown in the left hand side of FIG. 4. The lateral edges 14 and 15 of the blank which will form the vertical corners of the packaging article are subsequently folded into V-shape by means of the V-shaped guides 16 and 17 as indicated on the right hand side of FIG. 4, guides 16 and 17 being moved by means of pneumatic or hydraulic pistons.

Figure 5:
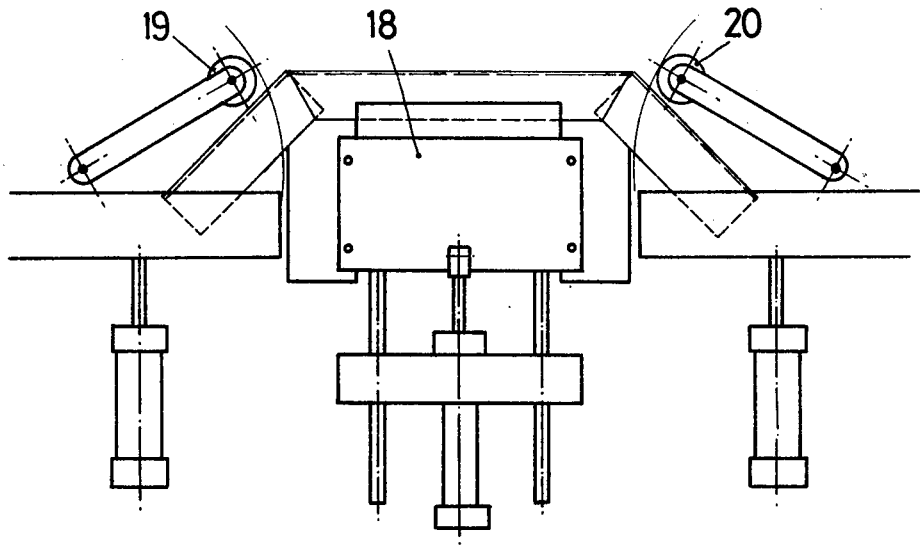

As shown in FIG. 5, the central base part of the blank is raised by being pushed upwards by means of pusher 18. At the same time, the rollers 19 and 20 of the suitable weight bear on the sides of the blank and effect folding of the sides relative to the base.

Figure 6:
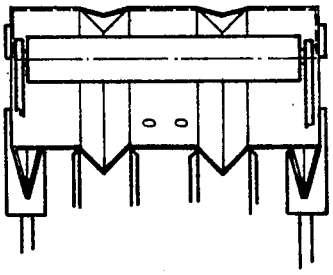
Figure 7:
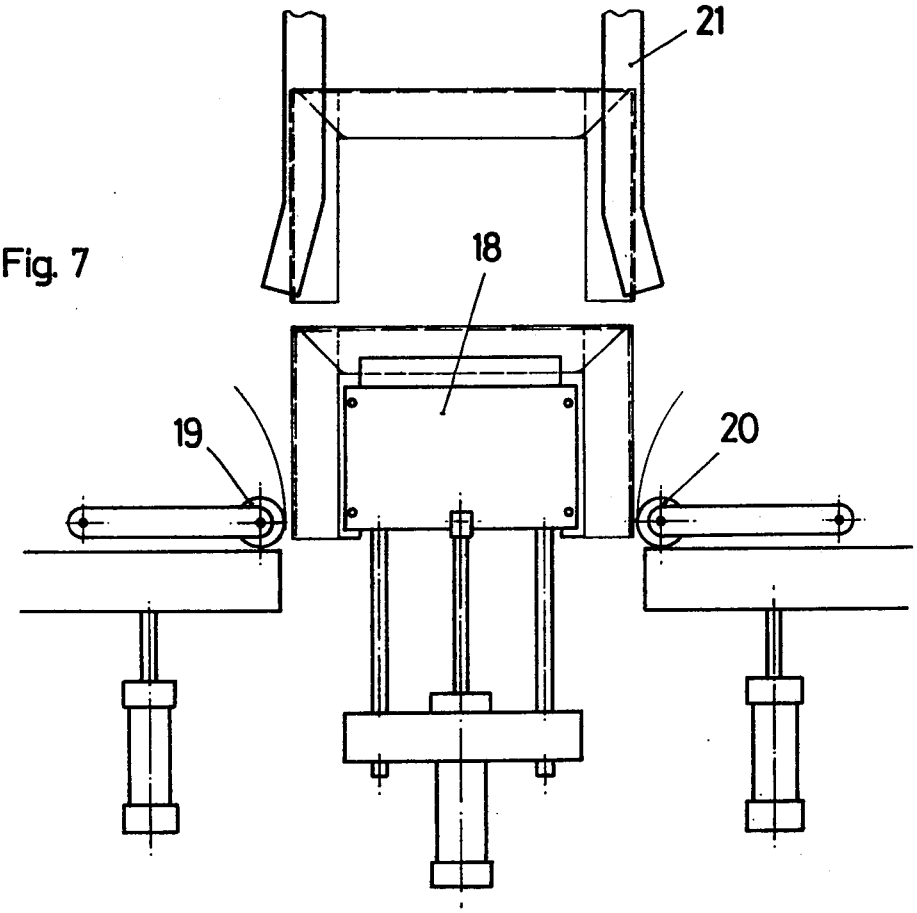

FIG. 6 illustrates the arrangement of FIG. 5 in side view. FIG. 7 indicates the final shaping of the article. The rollers 19 and 20 are returned by gravity to their starting position. The pusher 18, which is stopped in a raised position, is provided with means for holding the ribs in folded condition until the glue sets thus forming the finished articles. Such means for holding the ribs folded may be the same as those to be described in relation to FIGS. 9–18.

Figure 8:
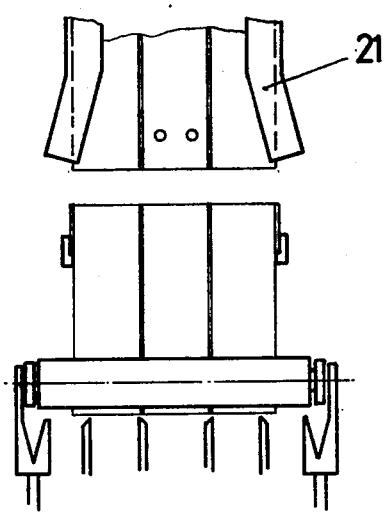

FIG. 8 illustrates in transverse view showing the position at the end of this operation. The central part 18 has been lowered but will be raised again inserting next formed article in the frame or hopper 21 so that it will push the previously made boxes out of the machine.

The second embodiment of the machine will now be described with reference to FIGS. 9 to 18.

Figure 9:
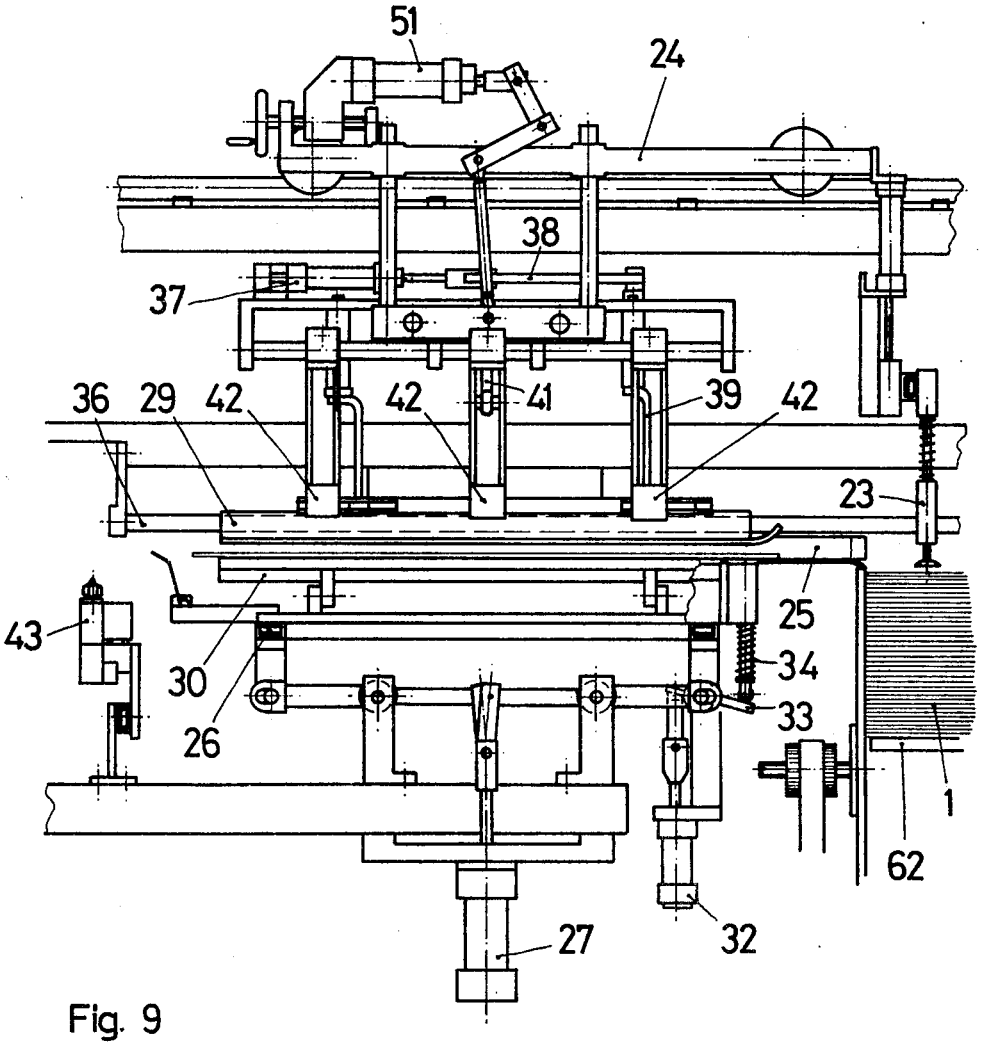
Figure 10:
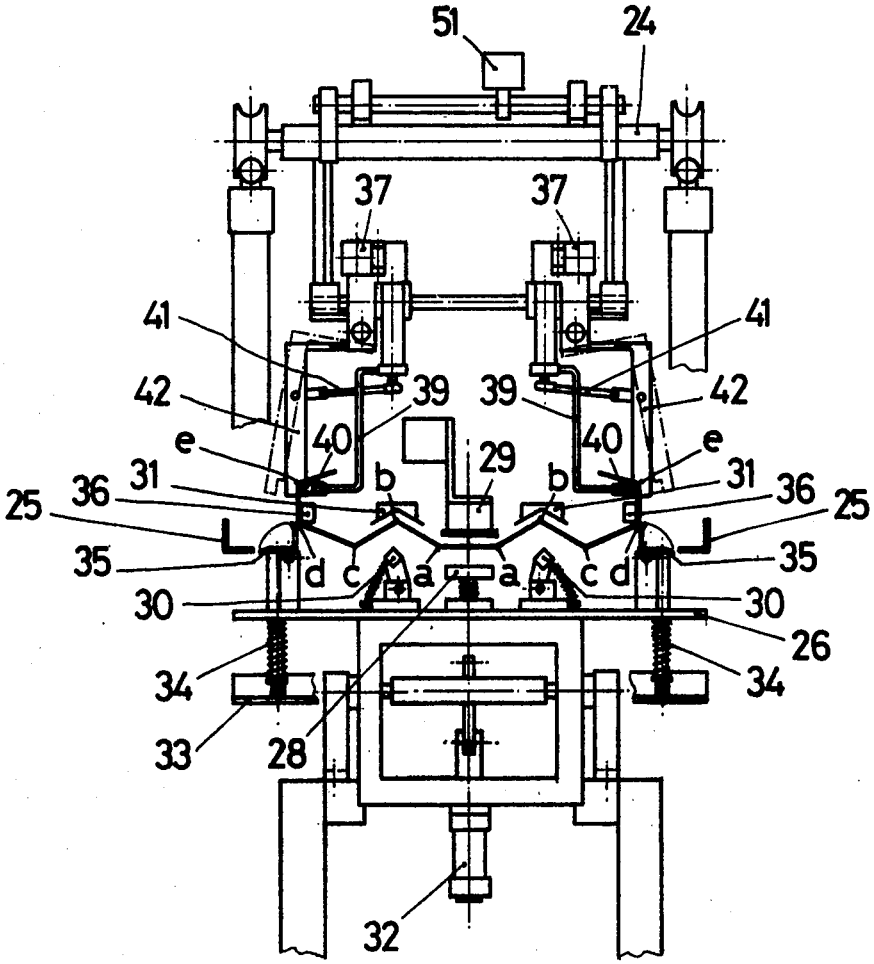

The blanks are stacked on a platform 62 (FIG. 9). A carriage 24 (FIGS. 9 and 10) is operated in a to and fro movement of translation by a long lever controlled by a cam and by two adjustable suckers 23 (FIG. 9) takes blanks one by one and places them in the first folding station. The guides 25 (FIGS. 9 and 10) serve to hold the said blank straight as it moves from right to left in FIG. 9. The platform 26 (FIGS. 9 and 10) is now operated by the cylinder 27 (FIG. 9). The presser 28 (FIG. 10) which is spring actuated, locks the blank along the whole of its length against the fixed guide 29 (FIGS. 9 and 10). In the meantime the focusing bars 30 (FIGS. 9 and 10) press corresponding to the creasing of the blank against the fixed guides 31 (FIG. 10) giving rise to the folds a, b.

Immediately after this, the piston 32 (FIGS. 9 and 10) operates by means of the lever 33 (FIGS. 9 and 10) the pins 34 (FIGS. 9 and 10) which, with the aid of a toothed rack, swing the hinged plates 35 (FIG. 10) by 90° to fold the blank against the fixed guides 36 (FIGS. 9 and 10) thus effecting the folds c,d. The carriage 24 in the meantime is returned to the initial load position.

The cylinder 37 (FIGS. 9 and 10) now comes into operation and by means of the connecting rod 38 (FIG. 9) operates to eccentric lever 39 (FIGS. 9 and 10). This brings the longitudinal bars 40 (FIGS. 9 and 10) against the vertical blanks of the blank. At the same time the connecting rod 38 operates another eccentric lever which operates the small connecting rods 41 (FIGS. 9 and 10) and these fold the blank against the bars 40 by operating the pincers 42 (FIGS. 9 and 10). The said pincers also effect the folds "e".

The cylinders 27 (FIG. 9) and 32 (FIGS. 9 and 10) now cease their operation, leaving the hinged plates 35 (FIG. 10) to reopen and the platform 26 (FIGS. 9 and 10) is lowered thus releasing the blank.

Figure 11:
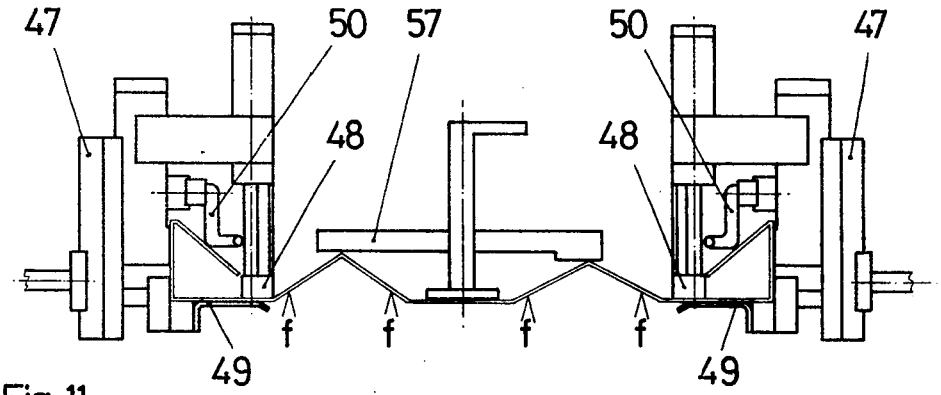
Figure 12:
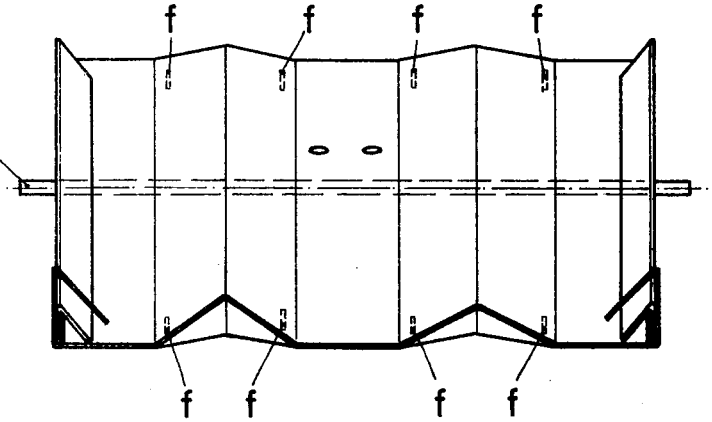

This latter, held by the stems 40 (FIGS. 9 and 10) and the pincers 42 (FIGS. 9 and 10), now advances with the carriage 24 (FIGS. 9 and 10) to the next station. In this advancing phase, the fusible glue, hot or cold, is sprayed from under the blank onto the blank to the positions "f" (FIGS. 11 and 12). Spraying of the glue is from the heads 43 (FIG. 9). The carriage is then stopped in the next station shown in FIG. 16.

The cylinder 44 (FIG. 16) causes the stems 45 (FIGS. 12, 14, 16) to rise and immediately after this the cylinders 46 (FIGS. 16) carry the two pressure formers 47 (FIGS. 11, 14, 16) whilst in the meantime also the small levers 50 (FIGS. 11, 14) operated by a small piston with toothed rack are lowered to hold folded the lateral sides of the blank.

Figure 13:
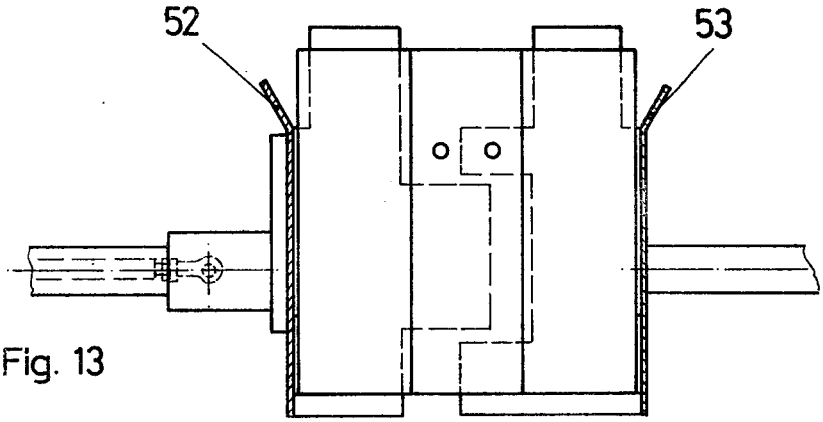
Figure 14:
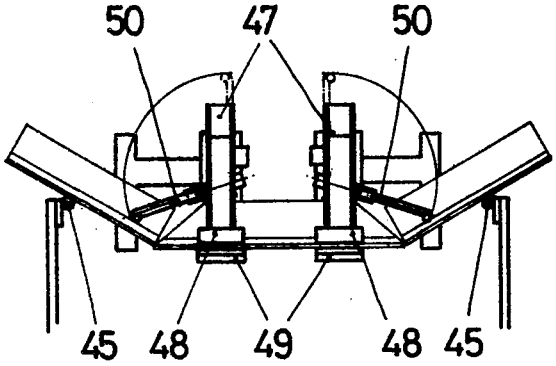
Figure 15:
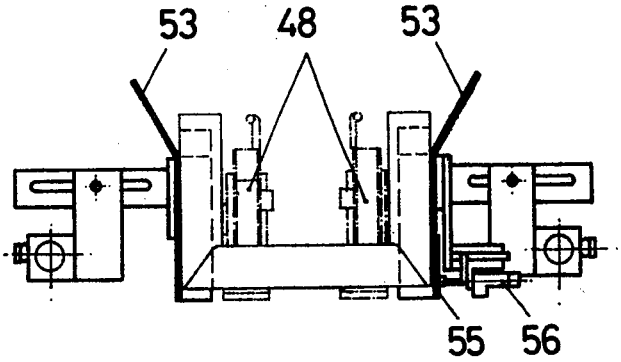
Figure 16:
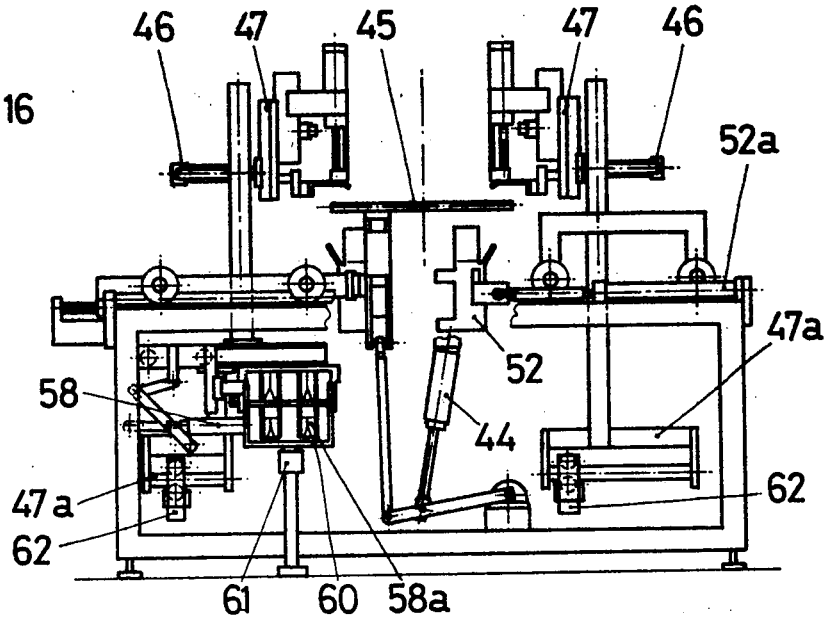

The bar 40 (FIGS. 9 and 10) and the pincers 42 (FIGS. 9 and 10) now reopened releasing the blank, whilst the whole block of pincers is raised by means of the cylinder 51 (FIGS. 9, 10). The pressers 48 (FIGS. 11, 14) are operated, and this blocks the blank against the plates 49 (FIGS. 11, 14). The stop 57 (FIG. 11) serves to keep the blank in the adjusted position. The carriage 24 now returns to the initial position ready for processing another blank. The pressure formers 47 (FIG. 11) being fixed on the movable vertical carriages **47*a* (FIG. 16) are pulled downwards by the levers 62 (FIG. 16) which are cam controlled. In this movement of descent, the blank is introduced into the open hoppers 52 and 53 (FIGS. 13 and 15). Before the blank reaches the bottom of hoppers 52 and 53, the pressers 48 (FIGS. 11 and 14) are raised and also the presser carrier stations 47 (FIG. 16) are reopened leaving the blank in the hoppers as indicated in FIG. 12. Immediately, however, the movable hopper 52 (FIGS. 13 and 16) is closed with the aid of the cylinder 52*a* (FIG. 16) forming the article in final form. Immediately afterwards, the supplementary hopper 55 (FIG. 15) also comes into operation and this hopper, controlled by the cylinder 56 (FIG. 15) serves to straighten and hold the box in the hopper before the last phase. The last phase begins when the vertical carriages 47*a* (FIG. 16) are again raised upwards. The securing pincers of the holders 54, 54*a* (FIGS. 17 and 18) then come into operation. These are controlled by the cylinders 58 (FIG. 16) and enter while open into the packaging article and are aligned with the central folds (FIGS. 17 and 18). Now the said pincers, since they are integral with the vertical carriages initiate a now descending phase, remaining open. After a short distance of descent, the lower movable parts 45*a* of the pincers 54 (FIG. 17) are rotated by about 60° by means of the cylinder 59 (FIGS. 17 and 18**).

Immediately after the rotation of the pincer parts **45*a* the pincers are closed by a suitable cylinder to press the folds at the places where previously the glue has been sprayed. At the time as the article is held the pincers it continues downwards movement and the hoppers 52 (FIGS. 13 and 16**) reopen very quickly ready to receive the next article.

Then descending phase terminates, the pincers 54–**54*a* (FIGS. 17 and 18) again by the operation of the cylinder 58 (FIG. 16) are moved finally above the outlet track 60 (FIG. 16) and release the article from the grip of the said pincers. The pincers released from the article rise again ready for the next operation. The cylinder 61 (FIG. 16**) provides a means for extruction of the finished article with folds.

FIG. 20 shows the article produced by the machines described. It is a U-shaped article which may be loosely described as a box.

It is provided for the shape of the parts constituting the various members comprising the machine in question to vary and for the members known per se to be replaced by other equivalent members of known type without departing from the scope of protection of the patent.

I claim:

1. A machine for erecting packaging sheet material such as cardboard into packaging articles having a base and lateral walls and at least one rib comprising at least one glued fold, said machine comprising opposed longitudinally extending first members adapted to move toward and away from each other with said sheet material between them to fold the sheet material to initiate the formation of said at least one rib, second members adapted to fold two lateral edges of the sheet material to form reinforcement of the walls and to fold said edges into V-shape, third members adapted to insert glue in said at least one fold and to close the same to complete the formation of said at least one rib, fourth members adapted to fold by 90° both lateral walls of the article relative to the base of the box about fold lines that are parallel to each other and perpendicular to said at least one rib, a fixed frame which holds the box in its final shape until setting of said glue takes place, and fifth members adapted to insert the finished box into said frame.

2. A machine as claimed in claim 1, in which said second members fold each lateral edge of the sheet twice in the same direction with said V-shaped folded edges extending away from said base in the same direction as said at least one rib.

3. A machine as claimed in claim 2, in which said second members comprise two right-angled formers hinged at one end and a fixed guide about which said formers bend said edges to fold said edges twice.

4. A machine as claimed in claim 3, in which said second members also include V-shaped guides movable toward and away from said base to complete folding of said edges.

5. A machine as claimed in claim 1, in which said first members on one side of saidmaterial are fixed and said first members on the other side of said material are mounted for movement with at least some of said second members toward and away from said material.

6. A machine as claimed in claim 1, said fourth members comprising two rollers swingably supported by arms, said rollers and arms being of sufficient mass to fold the lateral walls of the sheet material as the base of the sheet material passes said rollers.

* * * * *